US005380395A

United States Patent [19]

Uchida

[11] Patent Number: 5,380,395

[45] Date of Patent: Jan. 10, 1995

[54] AUTOMATIC ADHESIVE TRANSFER DEVICE

[75] Inventor: Hiromichi Uchida, Tokyo, Japan

[73] Assignee: Toyo Chemical Co., Ltd., Tokyo, Japan

[21] Appl. No.: 25,631

[22] Filed: Mar. 2, 1993

[30] Foreign Application Priority Data

Dec. 28, 1992 [JP] Japan ..... 4-093799[U]

[51] Int. Cl.[6] ..... B32B 31/00

[52] U.S. Cl. ..... 156/577; 156/523; 156/541; 156/579

[58] Field of Search ..... 156/523, 526, 527, 541, 156/574, 577, 579, 584

[56] References Cited

U.S. PATENT DOCUMENTS

| | | | |
|---|---|---|---|
| 3,814,643 | 6/1974 | Wagner | 156/523 X |
| 3,890,191 | 6/1975 | Mayer | 156/584 X |
| 3,902,956 | 9/1975 | Thompson, Jr. | 156/523 |
| 3,969,181 | 7/1976 | Seabold | 156/579 X |
| 4,436,572 | 9/1982 | Makley | 156/541 X |
| 4,851,074 | 7/1989 | Uchida | 156/579 X |
| 4,923,559 | 5/1990 | Kennedy et al. | 156/579 X |

*Primary Examiner*—David A. Simmons
*Assistant Examiner*—James J. Engel
*Attorney, Agent, or Firm*—Wenderoth, Lind & Ponack

[57] ABSTRACT

An automatic adhesive transfer device using an adhesive tape is used to bond desired portions of paper or the like in offices, home, schools, etc. In the device, an adhesive tape roll, which is formed by winding an adhesive tape comprising a double-side release paper with an adhesive coating thereon, with the adhesive coated surface on the outer side, is loaded in a casing. In the use of the device, the adhesive tape roll can be rotated only in the direction of adhesive transfer and at a rotational speed suitable therefor. The device is thus not damaged by applying force to it in the opposite direction i.e., a rotation-blocked direction. In addition, it is possible to transfer the adhesive to a desired location accurately at all times.

15 Claims, 5 Drawing Sheets

AUTOMATIC ADHESIVE TRANSFER DEVICE

BACKGROUND OF THE INVENTION

In the prior art, an automatic adhesive transfer device is used with an adhesive tape with an adhesive coating thereon. FIG. 8 shows such an automatic adhesive transfer device, generally designated at 50. The device 50 is used with an adhesive tape comprising a double-sided release paper 51 with a pressure-sensitive adhesive coating 52 thereon. The adhesive tape is used in the form of a roll 53 with the adhesive-coated surface on the outer side. The adhesive tape roll 53 is rotatably loaded in a casing 54. The casing 54 has its top provided with a used tape exit 55, through which the release paper 51 after use, i.e., the used portion of the adhesive tape, is led out. Inside the casing 54, a stopper 56 is disposed at a position downstream of the tape exit 55 in the direction of rotation of or the adhesive tape roll for preventing the used portion of the release paper from remaining in the casing. Further, in order that the adhesive tape roll 53 should not be freely rotated while transferring the adhesive 52, a spring-like urging member 57 is mounted inside the casing 54 such that it is directed to follow the direction of rotation of the adhesive tape roll 53. The urging member 57 has a free end 58 which is in contact with an adhesive-free edge portion of the release paper 51, and thus is applying a braking force to the adhesive tape roll 53 to block free rotation thereof while not in contact with the adhesive 52.

However, since the spring-like urging member urges the adhesive tape roll only with its free end, it cannot restrict the direction of rotation of the adhesive tape roll to only the direction of adhesive transfer. This means that, in the case of an automatic adhesive transfer device which is designed such that the casing is pulled toward the user for the adhesive transfer, no adhesive can be transferred if it is pushed, as Westerners habitually do. Such an erroneous operation may damage the adhesive tape roll and, in an extreme case, spoil the function of the device.

Further, with the above prior art automatic adhesive transfer device, it is necessary for the urging member to urge the adhesive tape roll adequately at all times while the adhesive tape roll is reduced in diameter gradually in use. This means that a sophisticated design is necessary concerning the shape, mounting angle, length, degree of elasticity, etc. of the urging member. Therefore, a great deal of time and labor are required for the fabrication and mounting of the urging member.

Furthermore, manual control of the rotational speed of the adhesive tape roll at a constant speed is very difficult. Therefore, very frequently the adhesive is transferred beyond the desired end position due to excessive speed caused in the adhesive transfer operation.

SUMMARY OF THE INVENTION

A primary object of the invention is to provide an automatic adhesive transfer device which can reliably prevent free rotation of the adhesive tape roll and permits the adhesive tape roll to be rotated only in the direction of adhesive transfer and not in the opposite direction, thus permitting even an infant or a person in any country to carry out the adhesive transfer operation safely and accurately at all times.

Another object of the invention is to provide an automatic adhesive transfer device which can adequately brake the rotation of the adhesive tape roll to provide for a constant rotational speed thereof suited for the transfer of the adhesive, thus permitting an accurate adhesive transfer operation to be carried out very readily without exceeding the desired adhesive transfer end position.

DETAILED DESCRIPTION OF THE EMBODIMENT

Figure 1:
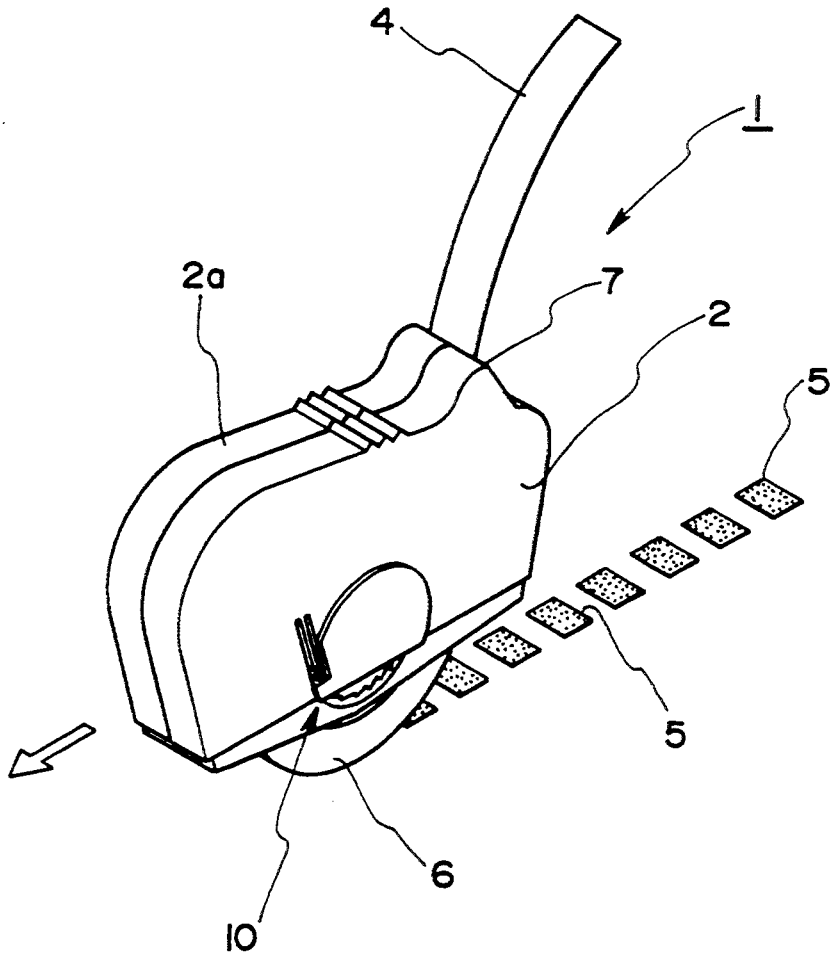
FIG. 1 is a perspective view showing an automatic adhesive transfer device embodying the invention.

Referring to FIGS. 1 to 7, there is shown an automatic adhesive transfer device 1 embodying the invention. The device has a casing 2 with a cover 2*a*. An adhesive transfer adhesive tape roll support shaft 3 is accommodated in the casing 2, and an an adhesive transfer adhesive tape roll 6 is supported for rotation on the support shaft 3. In this embodiment, the adhesive tape roll 6 comprises an adhesive tape comprising a double-sided release paper 4, on one surface 4*a* of which uniformly spaced-apart patches 5 of an adhesive material are coated in a row extending in the longitudinal direction of the release paper while leaving opposite adhesive-free edge portions thereof. It is of course possible to coat the adhesive continuously over the entire area of one surface of the double-side release paper 4.

The casing 2 has its top provided with a release paper exit 7. Inside the casing 2, a release paper discharging member 8 is mounted thereon at a position downstream the release paper exit 7 in the direction of rotation of the adhesive tape roll 6 so as to prevent a used portion of the release paper 4 after use, i.e. the used portion of the adhesive tape, from remaining in the casing 2 without getting out through the release paper exit 7. The release paper discharging member 8 has a stem 8*a*, which is pivotally coupled, by loose fitting for instance, to a discharging member support formed on the inner surface of the casing 2. It also has a contact end 8*b*, which is held in contact with the front side adhesive-free edge portion of the adhesive tape roll by the weight of the member 8 itself, thus permitting the release paper 4 to get out of the casing through the release paper exit 7 without remaining in the casing. Inside the casing 2, a paper cutter 9 is disposed inwardly of the release paper exit 7. The adhesive tape cutter 9 includes a cutter part 9*b*, which is rotatably mounted on the casing 2, a cutter blade 9*a* for cutting the release paper 4 and an urging part 9*c* that extends downward from the cutter part 9*b* for urging the release paper 4 proceeding toward the exit 7. When the the release paper 4 is increased considerably, it is cut off with the release paper cutter 9.

FIGS. 3 to 7 show the relation between a hollow core 11 of the adhesive tape roll 6 and a ratchet mechanism 10.

In the core 11 of the adhesive tape roll 6 is fitted a ratchet mechanism member 12, which has a substantially channel-shaped sectional profile and has a ratchet 13 on one side of it. The ratchet mechanism member 12 has a central hole 12*a*, which is penetrated by the adhesive tape roll support shaft 3. Its outer periphery has wedge-like ridges 12*b* which are wedged into the core 11 from the inner peripheral surface thereof so that it is secured to the core 11. The inner surface of the casing 2, on the side of the ratchet 13, is formed with a recess 14 in which the ratchet 13 is accommodated. A ratchet pawl 15 projects from the peripheral surface of the recess 14 for meshing with teeth of the ratchet 13.

Figure 4:
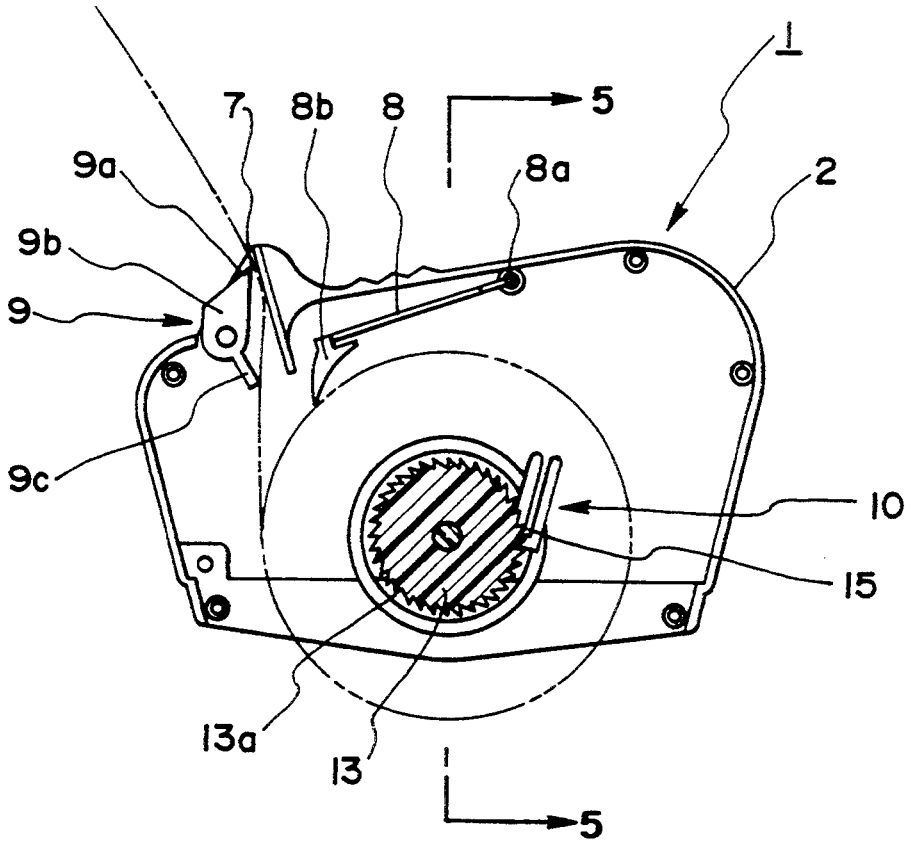
FIG. 4 is an elevational view, partly in section, showing a ratchet mechanism in the device of FIG. 1.
Figure 5:
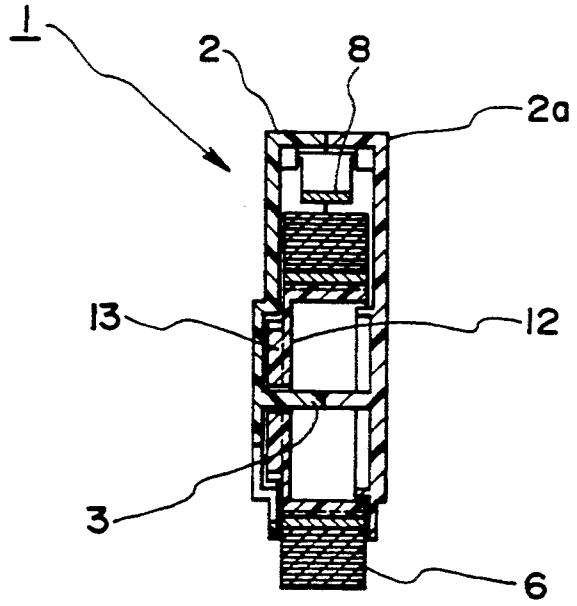
FIG. 5 is a sectional view taken along line 5—5 in FIG. 4.
Figure 6:
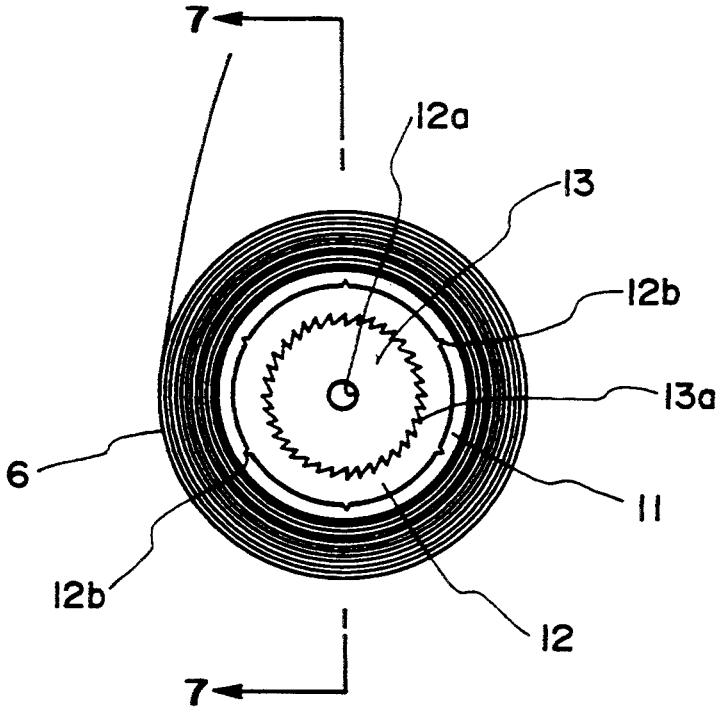
FIG. 6 is an elevational view showing a double-side release adhesive tape used with the device of FIG. 1.
Figure 7:
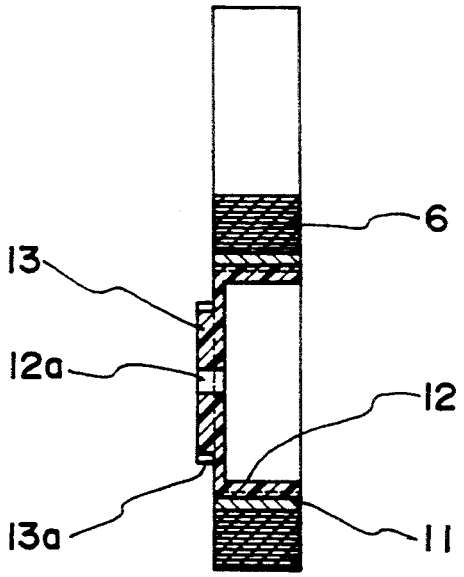
FIG. 7 is a sectional view taken along line 7—7 in FIG. 6.
Figure 8:
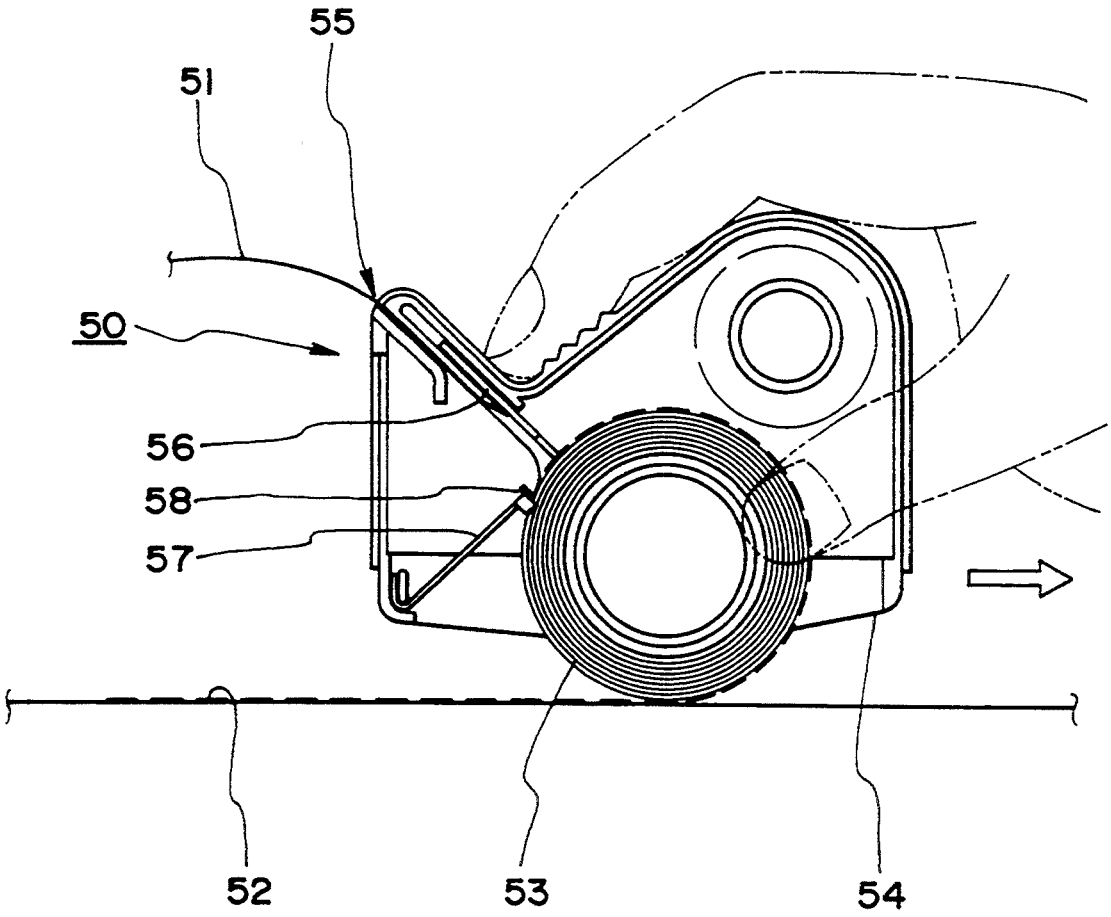
FIG. 8 (Prior Art)
FIG. 8 is an elevational view showing a prior art automatic adhesive transfer device with a cover thereof removed.

In operation, when the ratchet 13 is rotated in the clockwise direction in FIG. 4, the ratchet pawl 15 is flexed to permit the ratchet teeth 13*a* to pass by it. When the ratchet 13 is rotated in the counter-clockwise direction, on the other hand, the ratchet pawl 15 gets into meshes with one of the ratchet teeth 13*a* to block the rotation of the ratchet 13. The ratchet 13 and ratchet pawl 15 have their shapes and disposition angles designed such as to permit the above operation.

Figure 2:
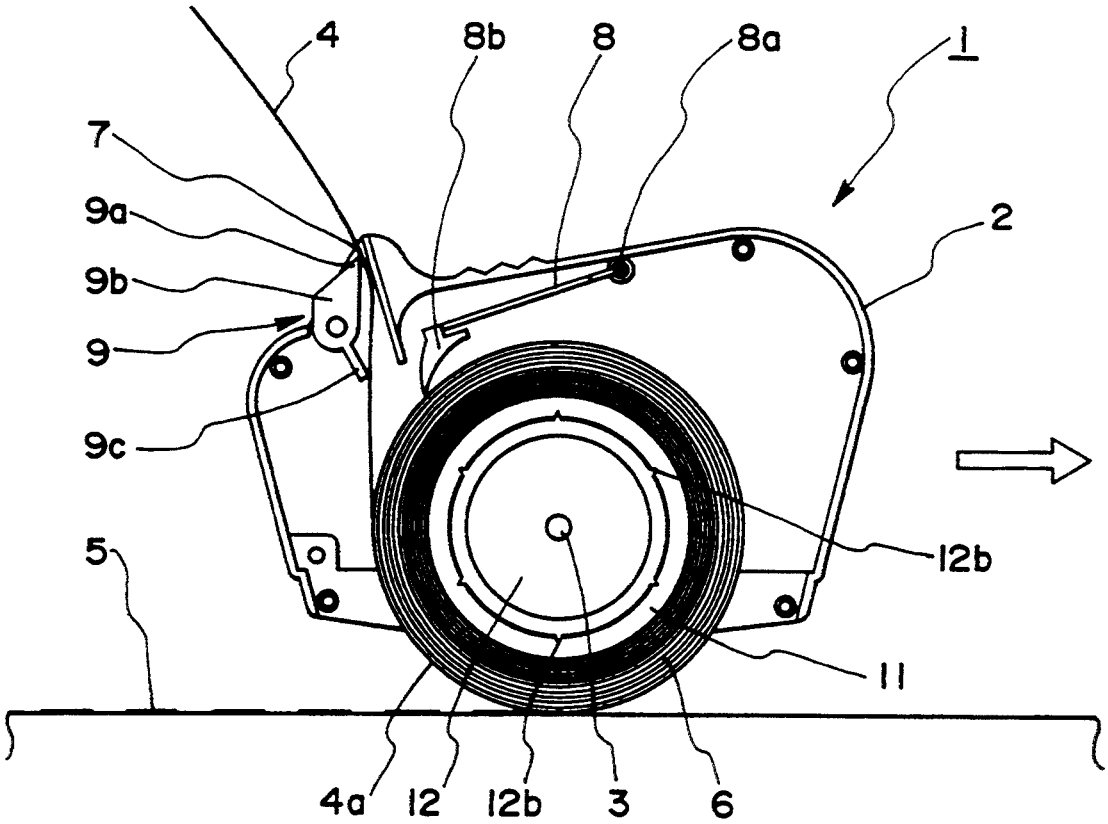
FIG. 2 is an elevational view showing the device of FIG. 1 with a cover thereof removed.
Figure 3:
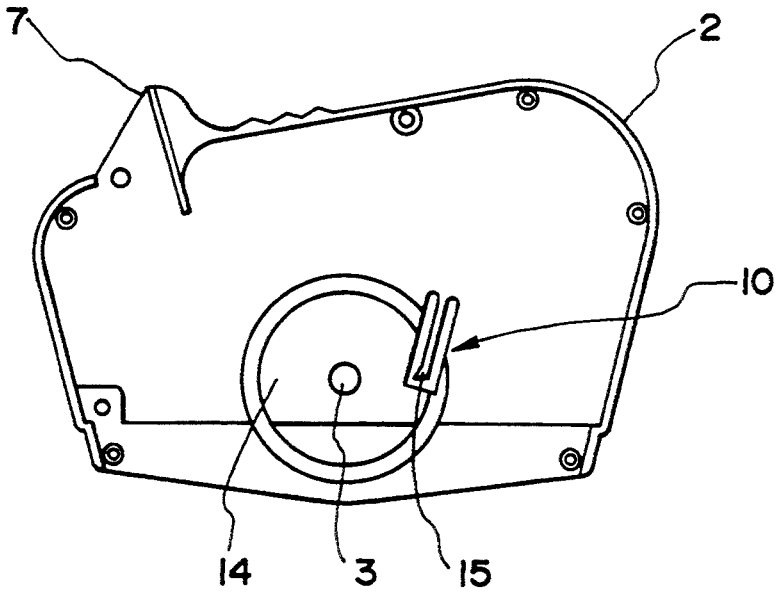
FIG. 3 is an elevational view showing the inside of the casing of the device of FIG. 1.

This embodiment of the automatic adhesive transfer device 1 is designed such that the adhesive tape roll 6 can be rotated when and only when it is moved to the right as shown in FIG. 2. That is, by applying a force to the device in this direction, the adhesive tape roll 6 can be rotated smoothly, and thus a satisfactory adhesive transfer operation can be obtained. However, by pushing the device to the left in FIG. 2, the rotation of the adhesive tape roll 6 is blocked by the function of the ratchet mechanism 10.

In the ratchet mechanism 10 of this embodiment, the ratchet 13 is provided on the ratchet mechanism member 12 on the side of the adhesive tape roll 6, while the ratchet pawl 15 is provided on the side of the casing 2. However, it is possible to obtain the same function and effects with a converse arrangement, that is, by providing the ratchet pawl 15 on the ratchet mechanism member 12 and providing the ratchet 13 on the casing 2.

With the above ratchet mechanism provided in the automatic adhesive transfer device according to the invention, the adhesive tape roll is not rotated freely, that is, it can be rotated only in the direction of the adhesive transfer and cannot be rotated by applying a force to the device in the opposite direction. Thus, the device permits even an infant or a person in any country to transfer adhesive smoothly at all times and without the possibility of erroneous operation. Thus, there is no possibility of destroying the device with the erroneous application of a great force to the device in the wrong direction, thus eliminating otherwise possible trouble in the exhausting of the used portion of the double-side release paper from the device.

Further, unlike the prior art automatic adhesive transfer device, there is no need for urging the adhesive tape roll with an adequate force with a spring-like urging member, which is required to provide a sophisticated touch, and hence dictates a correspondingly complicated contrivance. It is thus possible to provide an automatic adhesive transfer device which is very simple in construction that can be readily handled and is free from trouble even when operated erroneously.

Further, since the ratchet mechanism is provided, unlike the prior art automatic adhesive transfer device, there is no possibility of transfer of the adhesive beyond a desired end position due to an excessive rotational speed of the adhesive tape roll that may be caused because the adhesive tape roll is rotated manually with difficult rotational speed control, but it is possible to readily transfer the adhesive accurately.

What is claimed is:

1. An automatic adhesive transfer device, comprising:

a casing;

adhesive tape comprising double-sided release paper in the form of an adhesive tape roll having an outer side surface coated with adhesive, said adhesive tape roll being rotatably mounted in said casing;

said casing having a bottom having an opening exposing said outer side surface of said adhesive tape coated with adhesive and a top having an exit for discharging a used portion of said double-sided release paper;

a ratchet mechanism including a ratchet mechanism member connected with one of said adhesive tape roll and said casing and a ratchet pawl engaging said ratchet mechanism member so as to allow rotation of said adhesive tape roll in only a direction of adhesive transfer connected with the other of said adhesive tape roll and said casing; and a tape cutter disposed adjacent to said exit, said tape cutter having an upper end cutter blade for cutting of said used portion of said double-sided release paper and an urging part urging said used portion of said double-sided release paper in said casing.

2. The automatic adhesive transfer device of claim 1, wherein said adhesive tape roll is mounted on and rotatable with a hollow adhesive tape roll core, said ratchet mechanism member is integral with said hollow adhesive tape roll core and said pawl projects from said casing into engagement with said ratchet mechanism member.

3. The automatic adhesive transfer device of claim 2, wherein said hollow adhesive tape roll core is rotatably mounted on a tape roll shaft on said casing.

4. The automatic adhesive transfer device of claim 2, wherein said hollow adhesive tape roll core has a plurality of ridges on an outer periphery thereof wedged into engagement with an inner peripheral surface of said adhesive tape roll.

5. The automatic adhesive transfer device of claim 2, wherein said casing has a recess having a peripheral surface from which said pawl projects, said ratchet mechanism member being received in said recess.

6. The automatic adhesive transfer device of claim 1, wherein said ratchet mechanism member has teeth on a peripheral surface thereof directed in one direction and said pawl is directed in a direction opposite to said one direction.

7. The automatic adhesive transfer device of claim 1, wherein said adhesive tape roll has an adhesive-free edge portion and a release paper discharging member is disposed in said casing downstream of said exit in the direction of rotation of said adhesive tape roll, said release paper discharging member being held in contact by gravity with said adhesive-free edge portion of said adhesive tape roll to prevent the used portion of said double-sided release paper from remaining in said casing.

8. An automatic adhesive transfer device, comprising:

a casing;

adhesive tape made of double-sided release paper in the form of an adhesive tape roll having an outer side surface coated with adhesive, said adhesive tape roll being rotatably mounted in said casing;

said casing having a bottom having an opening exposing said outer side surface of said adhesive tape coated with adhesive and a top having an exit for discharging a used portion of said double-sided release paper;

means for allowing rotation of said adhesive tape roll in said casing in only a direction of adhesive transfer; and a tape cutter disposed adjacent to said exit, said tape cutter having an upper end cutter blade for cutting of said used portion of said double-sided release paper and an urging part urging said used portion of said double-sided release paper in said casing.

9. The automatic adhesive transfer device of claim 8, wherein said means comprises a ratchet mechanism including a ratchet mechanism member connected with one of said adhesive tape roll and said casing and a ratchet pawl engaging said ratchet mechanism member so as to allow rotation of said adhesive tape roll in only a direction of adhesive transfer connected with the other of said adhesive tape roll and said casing.

10. The automatic adhesive transfer device of claim 9, wherein said adhesive tape roll is mounted on and rotatable with a hollow adhesive tape roll core, said ratchet mechanism member is integral with said hollow adhesive tape roll core and said pawl projects from said casing into engagement with said ratchet mechanism member.

11. The automatic adhesive transfer device of claim 10, wherein said hollow adhesive tape roll core is rotatably mounted on a tape roll shaft on said casing.

12. The automatic adhesive transfer device of claim 10, wherein said hollow adhesive tape roll core has a plurality of ridges on an outer periphery thereof wedged into engagement with an inner peripheral surface of said adhesive tape roll.

13. The automatic adhesive transfer device of claim 10, wherein said casing has a recess having a peripheral surface from which said pawl projects, said ratchet mechanism member being received in said recess.

14. The automatic adhesive transfer device of claim 9, wherein said ratchet mechanism member has teeth on a peripheral surface thereof directed in one direction and said pawl is directed in a direction opposite to said one direction.

15. The automatic adhesive transfer device of claim 8, wherein said adhesive tape roll has an adhesive-free edge portion and a release paper discharging member is disposed in said casing downstream of said exit in the direction of rotation of said adhesive tape roll, said release paper discharging member being held in contact by gravity with said adhesive-free edge portion of said adhesive tape roll to prevent the used portion of said double-sided release paper from remaining in said casing.

* * * * *